US010934696B2

(12) United States Patent
Blum

(10) Patent No.: US 10,934,696 B2
(45) Date of Patent: Mar. 2, 2021

(54) JET REGULATOR HAVING A SLIT SHAPED RECESS TOOL ENGAGEMENT SURFACE

(71) Applicant: Neoperl GmbH, Mullheim (DE)

(72) Inventor: Gerhard Blum, Gutach (DE)

(73) Assignee: Neoperl GmbH, Müllheim (DE)

( * ) Notice: Subject to any disclaimer, the term of this patent is extended or adjusted under 35 U.S.C. 154(b) by 32 days.

(21) Appl. No.: 15/562,625

(22) PCT Filed: Apr. 8, 2016

(86) PCT No.: PCT/EP2016/000582
§ 371 (c)(1),
(2) Date: Sep. 28, 2017

(87) PCT Pub. No.: WO2016/177444
PCT Pub. Date: Nov. 10, 2016

(65) Prior Publication Data

US 2018/0087247 A1 Mar. 29, 2018

(30) Foreign Application Priority Data

May 5, 2015 (DE) ..... 202015003301.6

(51) Int. Cl.
*E03C 1/086* (2006.01)
*E03C 1/084* (2006.01)

(52) U.S. Cl.
CPC ..... *E03C 1/086* (2013.01); *E03C 1/084* (2013.01)

(58) Field of Classification Search
CPC . E03C 1/086; E03C 1/084; E03C 1/08; B05B 1/28; B05B 1/14; B25B 13/48; B25B 13/02; B25B 13/50; F16B 23/0015
(Continued)

(56) References Cited

U.S. PATENT DOCUMENTS 2,397,216 A * 3/1946 Stellin ..... F16B 23/0007 411/404
4,534,513 A * 8/1985 Aghnides ..... E03C 1/084 239/428.5

(Continued)

FOREIGN PATENT DOCUMENTS

| | | |
|---|---|---|
| DE | 29912115 | 10/1999 |
| EP | 2597213 | 5/2013 |
| EP | 2597214 | 5/2013 |

*Primary Examiner* — Tuongminh N Pham
(74) *Attorney, Agent, or Firm* — Volpe Koenig

(57) ABSTRACT

The invention relates to a jet regulator (3) having a jet regulator housing (4), which has, on the housing outer circumference thereof, an external thread (5), by means of which the jet regulator (3) can be mounted in an internal thread provided in the water outlet of a sanitary outlet fitting, wherein an outflow-side housing end face (6) of the jet regulator housing (4) is designed as a grid or mesh structure, which has throughflow holes (7) for the water flowing through the jet regulator (3) and which has at least one tool engagement surface designed as a slit-shaped recess (8, 9) in this grid or mesh structure and intended for a turning tool. It is characteristic of the jet regulator according to the invention that a second slit-shaped recess (9) is provided in the slit base of this first recess (8), the second recess likewise being intended as a tool engagement surface, and that the second recess (9) has a smaller recess cross section than the first recess (8).

20 Claims, 4 Drawing Sheets

(58) Field of Classification Search
USPC ..... 81/124.2, 124.4, 121.1, 439, 440
See application file for complete search history.

(56) References Cited

U.S. PATENT DOCUMENTS

| | | | | |
|---|---|---|---|---|
| 2003/0209113 | A1* | 11/2003 | Brooks | F16B 23/0038 81/439 |
| 2005/0178250 | A1* | 8/2005 | Hills | B25B 15/007 81/436 |
| 2009/0293684 | A1 | 12/2009 | Hughett et al. | |
| 2013/0134235 | A1* | 5/2013 | Blum | E03C 1/084 239/428.5 |
| 2014/0263753 | A1 | 9/2014 | Bush | |

* cited by examiner

JET REGULATOR HAVING A SLIT SHAPED RECESS TOOL ENGAGEMENT SURFACE

BACKGROUND

The invention relates to a jet regulator having a jet regulator housing, which has, on the housing outer circumference thereof, an external thread, by means of which the jet regulator can be mounted in an internal thread provided in the water outlet of a sanitary outlet fitting, wherein an outflow-side housing end face of the jet regulator housing is designed as a grid or mesh structure, which has throughflow holes for the water flowing through the jet regulator and which has at least one tool engagement surface designed as a slit-shaped recess in this grid or mesh structure and intended for a turning tool.

EP 2 597 214 A1 has already disclosed a jet regulator, which has a sleeve-shaped jet regulator housing bearing an external thread on the housing outer circumference thereof. With the aid of this external thread, the jet regulator housing can be screwed directly into an internal thread provided in the water outlet of a sanitary outlet fitting. The jet regulator is intended to shape the water flowing out of the outlet fitting into a uniform, non-splashing and possibly also gentle bubbling water jet. For this purpose, the outflow-side housing end face of the jet regulator housing is designed as a grid or mesh structure, which has a plurality of throughflow holes, in which the water flowing through the jet regulator is guided and shaped as it is guided. Since the previously known jet regulator hardly projects around the water outlet of the sanitary outlet fitting, at least one slit-shaped recess is provided on the outflow-side grid or mesh structure, said recess being intended, for example, as a tool engagement surface for a coin used as a turning tool, rather than for its normal purpose, the tool engagement surface allowing the screwed joint provided between the previously known jet regulator and the water outlet to be loosened or tightened in a simple manner.

Since the recess provided on the outflow-side housing end face is reminiscent of a screw slit and since, in particular, a coin suitable as a turning tool is also not always ready to hand for the plumber, many users are inclined instead to use a screwdriver, possibly also a small screwdriver with a correspondingly narrow screwdriver blade. Since a screwdriver hardly fills the slit-shaped recess, it is virtually impossible to apply to the previously known jet regulator the torque required, in particular, to loosen a screwed joint, which may also be clogged with limescale. If a small screwdriver is also used in this case, there is the risk that the screwdriver blade thereof will tilt and that, if an excessive torque is applied, the recess will be prized open at the sides and the surrounding grid or mesh structure will be expanded or destroyed and the jet regulator rendered unusable.

SUMMARY

It is therefore, in particular, the object to provide a jet regulator of the type stated at the outset which is designed in such a way that such incorrect operation is counteracted without thereby losing the desired compact construction of a jet regulator of this kind.

In the case of the jet regulator of the type mentioned at the outset, the solution according to the invention of this object consists, in particular, in that a second slit-shaped recess is provided in the region of the first recess, the second recess likewise being intended as a tool engagement surface but for a different turning tool, and in that the second recess has a smaller recess cross section than the first recess.

In the region of its outflow-side first recess, the jet regulator according to the invention has a second recess, which is likewise of slit-shaped configuration and is intended as a tool engagement surface. In comparison with the first recess, this second recess has a smaller recess cross section. While a coin used as a turning tool, rather than for its normal purpose, or the screwdriver blade of a relatively large screwdriver can be inserted into the comparatively larger first recess, it is also possible for a relatively small screwdriver to be inserted into the second recess. In this case, a turning tool of this kind can be used to turn a grid or mesh structure designed as a pivoted part, which is pivotably mounted in a joint socket on the housing inner circumference of the jet regulator housing, or, alternatively, the turning tool is used to tighten and loosen the screwed joint between the jet regulator and the water outlet. Since it is possible to counteract incorrect operation with the aid of the second recess, which accommodates even relatively small screwdrivers within it, and to do so without therefore having to form separate tool engagement surfaces projecting outside the grid or mesh structure, it is not therefore necessary to sacrifice the compact construction and structural design of a jet regulator of this kind.

The second slit-shaped recess can be arranged at a short distance from the first recess on the outflow-side housing end face of the jet regulator housing. However, there is a preference for an embodiment in which the second slit-shaped recess, which is likewise intended as a tool engagement surface, is provided in the first recess. An embodiment of this kind can have two recesses formed as a cross slit relative to one another, for example, of which the second recess has a smaller recess cross section than the first recess and possibly also has a shorter longitudinal extent in comparison.

A particularly advantageous and easy-to-handle embodiment according to the invention envisages that the second slit-shaped recess is provided in the slit base of the first recess, the second recess likewise being intended as a tool engagement surface. Since the second slit-shaped recess provided in the slit base of the first recess has a smaller recess cross section, it is also possible to insert a relatively small screwdriver into the second recess, said screwdriver passing through the first recess virtually without contact in this process.

The compact construction and the attractive design (including the aesthetic aspects) of the jet regulator according to the invention in the region of the outlet end structure thereof is further promoted if the first and the second recess have an identically shaped and preferably rectangular recess cross section with recess longitudinal sides and recess narrow sides that are shorter than the longitudinal sides.

In this case, a preferred embodiment according to the invention envisages that the first and the second recess have axially parallel longitudinal axes and that the second recess is arranged approximately centrally in the recess base of the first recess.

To ensure that a turning tool is well and reliably guided as it is inserted, even in the second recess, it is advantageous if the second recess is designed as a blind hole which has a, preferably closed, slit base on the side facing away from a frontal recess opening of the first recess. Thus, the turning tool can be inserted into the second recess only as far as the slit base thereof.

A preferred development according to the invention, by means of which the compact construction of the jet regulator according to the invention is also further promoted, envisages that the second recess extends into a protrusion which is formed on the end face of the grid or mesh structure which faces away from the recess opening of the first recess.

In this case, a preferred development according to the invention, which also allows relatively high torques to be absorbed and transmitted to the grid or mesh structure, envisages that the protrusion is reinforced by integrally formed reinforcing ribs, which project beyond the end face of the grid or mesh structure which faces away from the recess opening of the first recess and which preferably intersect one another in the extension thereof along the jet regulator longitudinal axis.

In order to be able to provide good guidance of the screwdriver blade of a screwdriver in the second recess as said screwdriver is inserted, it is advantageous if the recess cross section of the second recess tapers at least in some region or regions in the direction of the slit base thereof.

For this purpose, a preferred embodiment according to the invention envisages that the recess longitudinal sides and/or the recess transverse sides extend toward one another in the direction of the slit base. A particularly advantageous development according to the invention envisages that the first recess has a recess base in the form of a circular arc, wherein said recess base designed in the form of a circular segment is intended to receive a coin with a complementarily shaped outer contour used as a turning tool, rather than for its normal purpose. Not only does a recess base of this kind in the form of a circular arc well match the outer contour of a complementarily shaped coin used as a turning tool, rather than for its normal purpose, but, in addition, there is good guidance on this circular-arc-shaped recess base of the first recess for a turning tool intended for the second recess until said turning tool finds the recess opening of the second recess. The circular-arc-shaped configuration of the recess base of the first recess can thus significantly facilitate simple handling during the assembly of the jet regulator according to the invention.

A preferred embodiment according to the invention envisages that the second recess is intended to receive a screwdriver blade serving as a turning tool. Thus, whereas a coin used as a turning tool, rather than for its normal purpose, can be inserted into the first recess, the second recess is provided for a screwdriver used as another turning tool.

To enable even higher torques to be transmitted to the grid or mesh structure surrounding the recesses, it is advantageous if the throughflow holes are arranged at a distance from the recess longitudinal and/or from the recess narrow sides of the first recess which is greater than the wall thickness of dividing or flow-guiding walls which are arranged between adjacent throughflow holes of the grid or mesh structure.

In order to offer a sufficient contact surface to the turning tool inserted into the first recess at the longitudinal sides of said recess, it is advantageous if the jet regulator has a convexly arched or bulging housing end face. By virtue of the convex bulging of the outflow-side housing end face, the first recess also has, in the region of the jet regulator longitudinal axis, a correspondingly large longitudinal extent, which significantly increases in this region the contact area available to the turning tool.

As already explained above, the recesses in the housing end face which are intended for corresponding turning tools can be used to turn the grid or mesh structure, which is designed as a pivoted part and is pivotably mounted in a joint socket provided on the housing inner circumference of the jet regulator housing, in such a way that this grid or mesh structure optionally occupies an outflow angle which is modified in relation to the jet regulator longitudinal axis and which deflects the emerging water in said direction. In contrast, a preferred embodiment according to the invention which assists the handling of the jet regulator according to the invention even further envisages that the outflow-side housing end face is connected integrally to the jet regulator housing or to an outflow-side housing part of the multipart jet regulator housing.

If the jet regulator according to the invention is also supposed to shape a gentle bubbling outlet jet, i.e. an aerated outlet jet, it is advantageous if the jet regulator is designed as an aerated jet regulator or as a "jet aerator".

In this case, a preferred embodiment according to the invention envisages that the jet regulator housing or the outflow-side housing part has an inner housing circumferential wall and at least one outer housing circumferential wall, which surrounds the inner housing circumferential wall with a clearance, and that at least one air admission passage open to the outflow side of the jet regulator and opening into the interior of the jet regulator housing is provided in the interspace between the inner housing circumferential wall and the adjacent outer housing circumferential wall.

BRIEF DESCRIPTION OF THE DRAWINGS

Developments according to the invention will become apparent from the claims in conjunction with the description and the drawing. The invention is explained in greater detail below by means of a preferred illustrative embodiment.

In the drawing.

DETAILED DESCRIPTION OF THE PREFERRED EMBODIMENTS

Figure 3:
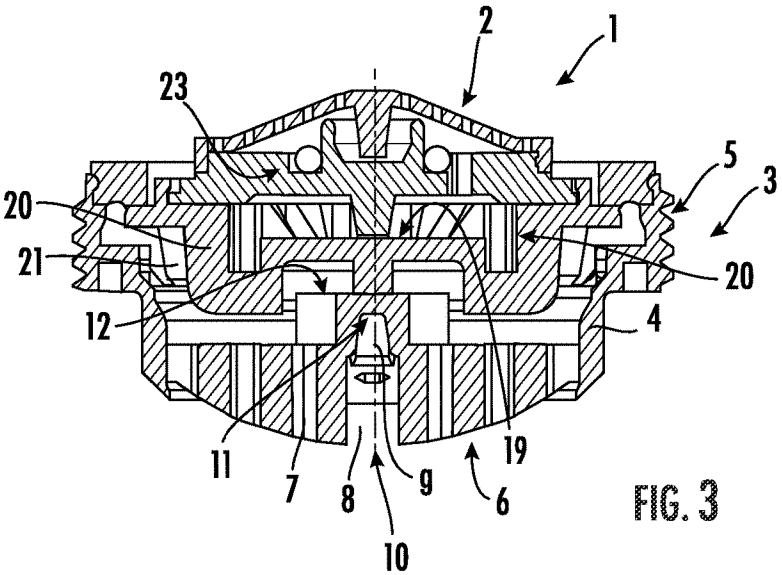
FIG. 3 shows the sanitary insert from FIGS. 1 and 2 in a longitudinal section turned through 90° relative to FIG. 2.
Figure 2:
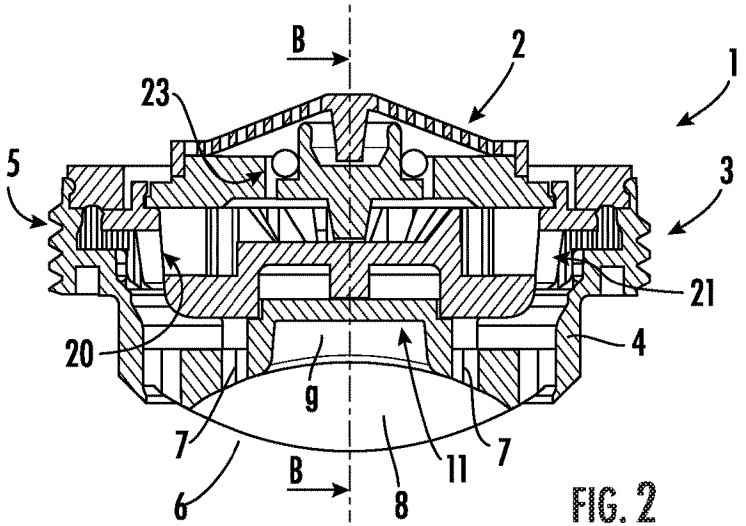
FIG. 2 shows the sanitary insert from FIG. 1 in a longitudinal section.
Figure 1:
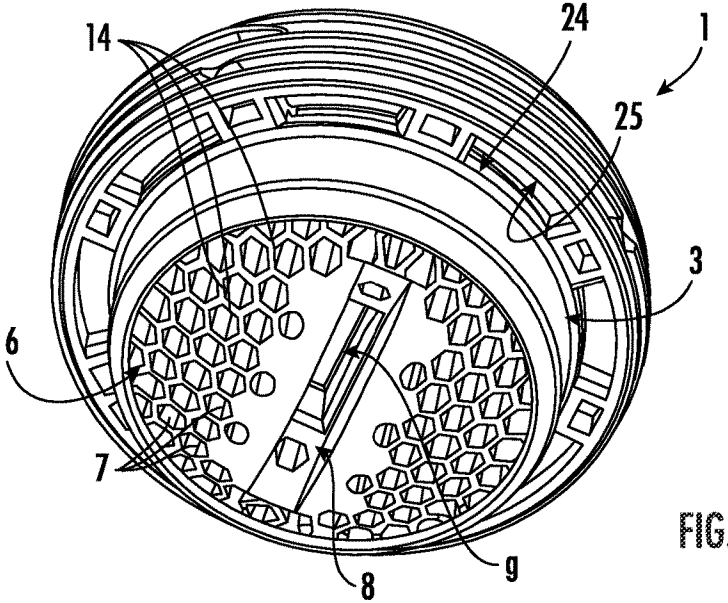
FIG. 1 shows a sanitary insert, which is illustrated in a perspective plan view of the outlet end thereof, can be mounted on the water outlet of a sanitary outlet fitting and has an outflow-side jet regulator, the jet regulator housing of which has an outflow-side housing end face which is designed as a grid or mesh structure and in which there are provided recesses, which each serve as a tool engagement surface for a turning tool.

FIGS. 1 to 3 show a sanitary insert 1, which can be mounted in the water outlet of a sanitary outlet fitting (not shown specifically here) and can be sealed off axially relative to this water outlet by a ring seal 26. The insert 1 has an inflow-side filtering or front screen 2, which filters out the dirt particles carried along in the inflowing water, which could otherwise impair the operation of this insert. The insert 1 also has an outflow-side jet regulator 3, the purpose of which is to shape the water flowing through into a uniform, non-splashing and possibly also gentle bubbling emerging water jet. A flow limiter, which reduces the flow cross section, can be provided between the inflow-side front screen 2 and the outflow-side jet regulator 3. Instead of this, however, a flow control valve 4 is arranged here, said flow control valve regulating the water flowing to the jet regulator 3 to a defined flow volume per unit time.

The jet regulator 3 of the insert 1 has a jet regulator housing 4, which is illustrated in greater detail in various views in FIGS. 4 to 9. On its housing outer circumference, the jet regulator housing 4 has an external thread 5, by means of which the jet regulator 3 and, together with the latter, also the insert 1 can be mounted in an internal thread provided in the water outlet of the sanitary outlet fitting. From FIGS. 1 to 10, it can be seen that an outflow-side housing end face 6 of the jet regulator housing 4 is designed as a grid or mesh structure, which has throughflow holes 7 for the water flowing through the jet regulator 3. This grid or mesh structure has at least one tool engagement surface designed as a slit-shaped recess 8, 9 in this grid or mesh structure and intended for a turning tool.

It is characteristic of the jet regulator 3 illustrated here that, in the slit base of a first recess 8, it has a second slit-shaped recess 9, which is likewise intended as a tool engagement surface for another turning tool, and that the second recess 9 has a smaller recess cross section than the first recess 8. In the slit base of the outflow-side first recess 8, the jet regulator 3 thus has the second recess 9, which is likewise of slit-shaped configuration and is intended as a tool engagement surface. In comparison with the first recess 8, this second recess 9 has a smaller recess cross section.

While a coin used as a turning tool, rather than for its normal purpose, or the screwdriver blade of a relatively large screwdriver can be inserted into the comparatively larger first recess 8, a relatively small screwdriver can also be inserted into the second recess 9, said screwdriver passing through the first recess 8 virtually without contact in this process. In this case, a turning tool of this kind can be used to turn a grid or mesh structure designed as a pivoted part, which is pivotably mounted in a joint socket on the housing inner circumference of the jet regulator housing, or, alternatively, the turning tool is used—as in the present case—to tighten and loosen the screwed joint between the jet regulator 3 and the water outlet. Since it is possible to counteract incorrect operation with the aid of the second recess 9, which accommodates even relatively small screwdrivers within it, and to do so without therefore having to form separate tool engagement surfaces projecting outside the grid or mesh structure, it is not therefore necessary to sacrifice the compact construction and structural design of a jet regulator 3 of this kind.

It is particularly apparent in FIGS. 1, 3, 4 and 9 that the first and the second recess 8, 9 have an identically shaped and, in this case, rectangular recess cross section with recess longitudinal sides and recess narrow sides that are shorter than the longitudinal sides. In this case, the longitudinal axes of these recesses 8, 9 are arranged approximately in one plane, and recess 9 is positioned approximately centrally or at the center in the slit base of the first recess 8.

The second recess 9 is designed as a blind hole which has a slit base 11, in this case a closed slit base, on the side facing away from a frontal recess opening 10 of the first recess 8. While the first recess 8 has recess longitudinal and recess narrow sides which extend approximately axially parallel to the jet regulator longitudinal axis, the recess cross section of the second recess 9 tapers at least in some region or regions in the direction of the slit base 11 thereof. For this purpose, the recess longitudinal and recess narrow sides of the second recess 9 extend toward one another in the direction of the slit base 11.

Figure 4:
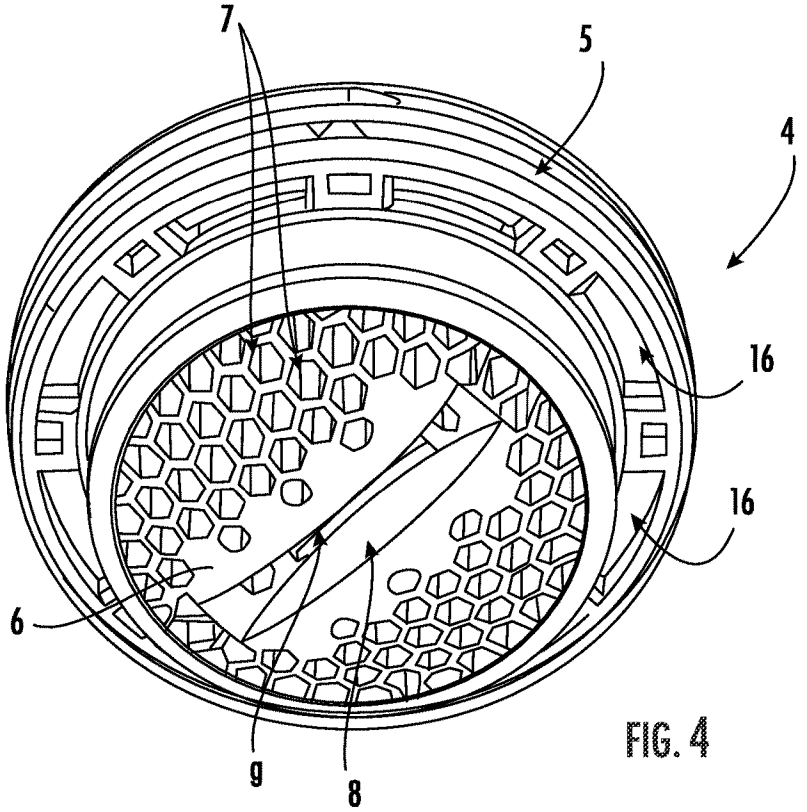
FIG. 4 shows the jet regulator housing of the jet regulator belonging to the sanitary insert according to FIGS. 1 to 3 in a perspective plan view of the outflow-side housing end face thereof, said housing being illustrated separately here.
Figure 8:
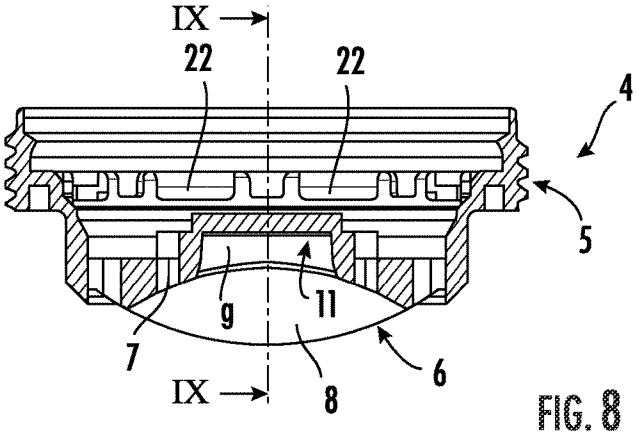
FIG. 8 shows the jet regulator housing from FIGS. 4 to 7 in a longitudinal section through section plane VIII-VIII from FIG. 7.

It is particularly apparent in FIGS. 2, 4 and 8 that the first recess 8 is of approximately circular-segment-shaped design and, for this purpose, has a recess slit base in the form of a circular arc. Thus, the first recess 8 is suitable for receiving a coin with an approximately complementarily shaped outer contour used as a turning tool, rather than for its normal purpose. In contrast, the second recess 9 is intended to receive a screwdriver blade serving as a turning tool. If the screwdriver blade of a correspondingly small screwdriver is inserted into the first recess 8, the screwdriver blade initially slides along the circular-arc-shaped slit base of the first recess 8 until the screwdriver blade finds the recess opening of the second recess 9. By virtue of the tapering configuration of the second recess 9, this screwdriver blade is then well held in the second recess 9 so that it can then receive and transmit a corresponding torque in the region of the jet regulator longitudinal axis and thus at the central point of the grid or mesh structure.

Figure 5:
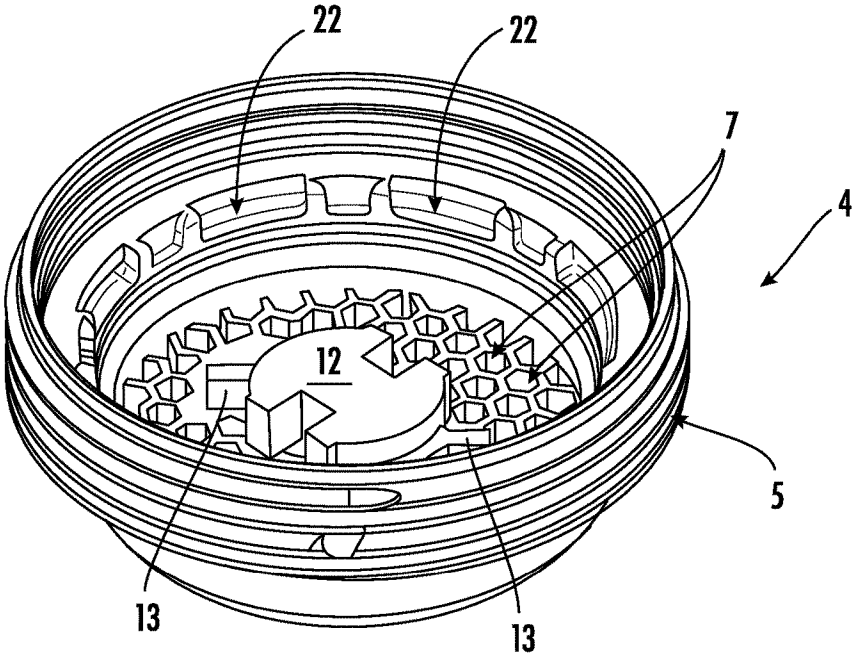
FIG. 5 shows the jet regulator housing from FIG. 4 in a perspective plan view of the inflow side of this jet regulator housing.
Figure 9:
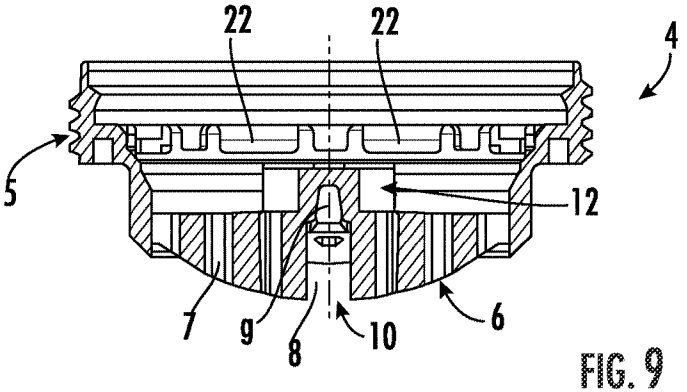
FIG. 9 shows the jet regulator housing from FIGS. 4 to 8 in a longitudinal section through section plane IX-IX from FIG. 8, said section having been turned through 90° in relation to FIG. 8.
Figure 6:
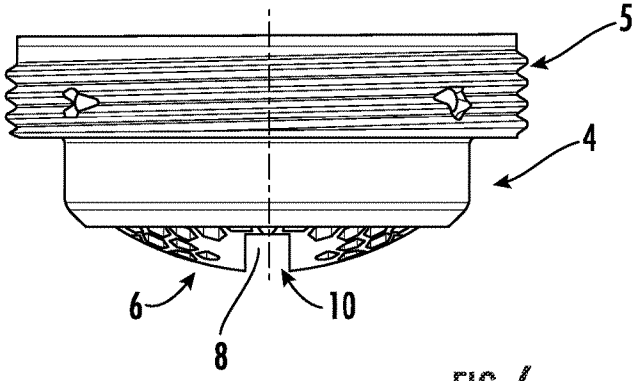
FIG. 6 shows the jet regulator housing from FIGS. 4 and 5 in a side view.
Figure 7:
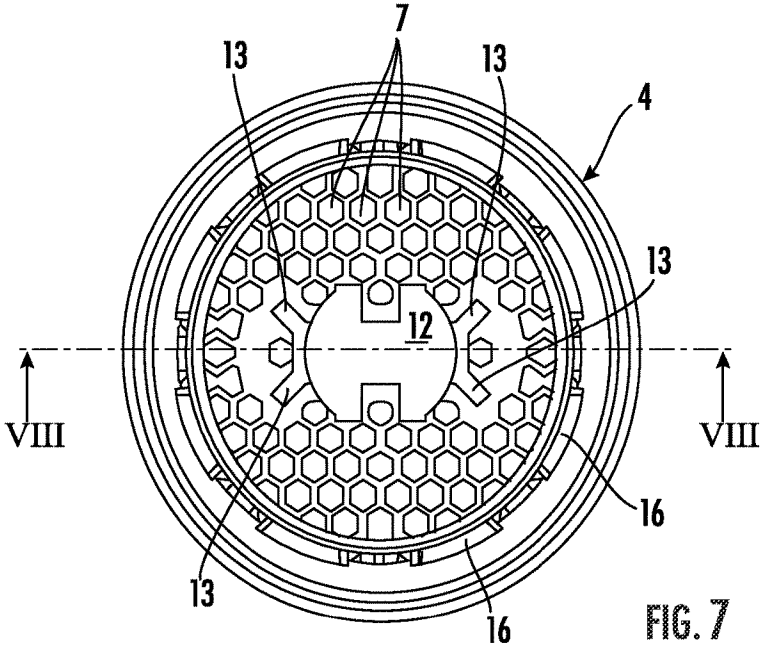
FIG. 7 shows the jet regulator housing from FIGS. 4 to 6 in a plan view of the inflow side facing the housing interior.
Figure 10:
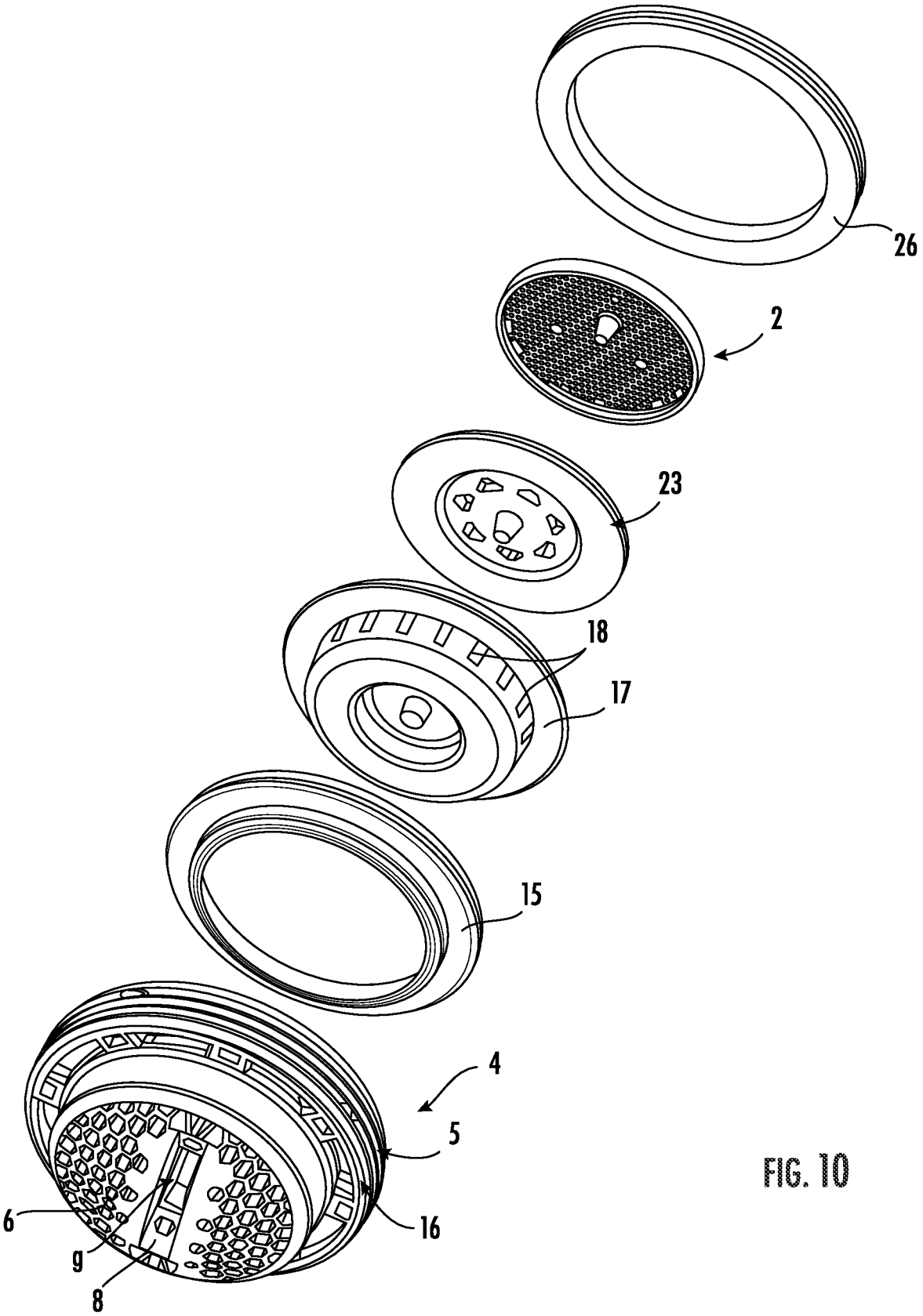
FIG. 10 shows the sanitary insert from FIGS. 1 to 3 in an exploded illustration of individual parts.

It is particularly clearly apparent in FIGS. 3, 5 and 7 that the second recess 9 extends into a protrusion 12, which projects beyond the end face of the grid or mesh structure which faces away from the recess opening 10 of the first recess 11. In order to prevent the grid or mesh structure cracking in the region of the recesses 8, 9, reinforcing ribs 13 are provided, which are formed on the protrusion 12, on the one hand, and on the grid or mesh structure, on the other hand. These reinforcing ribs 13 intersect one another in the extension thereof approximately in the region of the jet regulator longitudinal axis. To enable the grid or mesh structure to absorb and transmit the torques applied in the recesses 8, 9 effectively, the throughflow holes 7 are arranged at a distance from the recess longitudinal sides of the first recess 8 which is greater than the wall thickness of dividing or flow-guiding walls 14 of the grid or mesh structure, which are arranged between adjacent throughflow holes 7.

The grid or mesh structure has an outflow-side bulge in such a way that the jet regulator has a convexly arched housing end face. By virtue of the convex bulging of the housing end face, the recess longitudinal sides of the first recess 8 have an increased depth, thereby enlarging the contact area available to the turning tool.

The outflow-side housing end face 6 and thus also the grid or mesh structure is connected integrally to the jet regulator housing 4. Here, the jet regulator 3 is designed as an aerated jet regulator or as a "jet aerator". For this purpose, the jet regulator housing 4 has an inner housing circumferential wall 24 and an outer housing circumferential wall 25, which surrounds the inner housing circumferential wall 24 with a clearance, between which walls at least one air admission passage 16 open to the outflow side of the jet regulator 3 and opening into the interior of the jet regulator housing 4 is provided. The jet regulator 3 has a jet splitter 17 having a plurality of splitter openings 18. This jet splitter 17 deflects the through-flowing water outward toward the housing circumferential wall and divides the through-flowing water into individual jets. Here, this jet splitter 17 is designed as a pot-shaped diffuser, which has a pot base 19, which is oriented transversely to the throughflow direction of the inflowing water and serves as an impact surface that deflects the water sideways. The splitter openings 18, which are preferably arranged at uniform intervals, are provided on the circumferential wall 20 of this pot shape. These splitter openings 18 open into an annular passage 21, which tapers at least in some section or sections in the throughflow direction, wherein the at least one air admission passage 16 has its passage opening 22 leading into the housing interior arranged in a partial region of the housing inner circumference adjoining the annular passage 21 on the outflow side. Thus, the water flowing to the jet regulator 3, which has already been filtered in the front or filtering screen 2 and has been regulated to a defined maximum flow rate in the flow control valve 23 independently of the pressure, first of all strikes the pot base 19, serving as an impact surface, of the jet splitter 17 is deflected outward to the splitter openings 18 provided in the circumferential wall 20. The water divided into individual jets in the splitter openings 18 then flows into the annular passage 21, which tapers in the throughflow direction. Owing to the reductions in cross section in this region of the jet regulator 3 and owing to the tapering configuration of the annular passage 21, the water flowing through undergoes an increase in velocity, leading to a reduced pressure on the outflow side of the annular passage 21. Owing to this reduced pressure, ambient air is drawn into the housing interior of the jet regulator housing 4 through the air admission passages 16. The annular passage 21 is formed between the outer pot circumference of the jet splitter 17 and the inside of an adjacent diffuser ring 15, which is inserted into the jet regulator housing 4. The water flowing through is mixed with the ambient air drawn in in the mixing zone, arranged between the jet splitter 17 and the grid or mesh structure, of the jet regulator housing 4 before the water swirled and mixed with air in this way is once again shaped into a uniform, non-spraying and gentle bubbling water jet in the throughflow holes 7 of the grid or mesh structure.

LIST OF REFERENCE SIGNS

1 sanitary insert
2 front or filtering screen
3 jet regulator
4 jet regulator housing
5 external thread
6 outflow-side housing end face
7 throughflow holes
8 first recess
9 second recess
10 frontal recess opening of the first recess 8
11 slit base of the second recess 9
12 protrusion
13 reinforcing ribs
14 dividing or flow-guiding walls
15 diffuser ring
16 air admission passage
17 jet splitter
18 splitter openings
19 pot base
20 circumferential wall of the jet splitter 17
21 annular passage
22 passage opening
23 flow control valve
24 inner housing circumferential wall
25 outer housing circumferential wall
26 ring seal

The invention claimed is:

1. A jet regulator (3) comprising a jet regulator housing (4), having a housing outer circumference with an external thread (5), by which the jet regulator (3) is mountable in an internal thread provided in a water outlet of a sanitary outlet fitting, the jet regulator housing having an outflow-side housing end face (6) formed as a grid or mesh structure, which has flow-through holes (7) for water flowing through the jet regulator (3) and which has at least one tool engagement surface formed as a first slit-shaped recess (8, 9) in said grid or mesh structure that is adapted to receive a turning tool, and a second slit-shaped recess (9) defined by two longitudinal sides connected by two shorter sides is provided in a region of the first slit-shaped recess (8), the second slit-shaped recess providing a separate tool engagement surface from the first slit-shaped recess, the second slit-shaped recess (9) has a smaller recess cross section than the first slit-shaped recess (8), a protrusion (12) formed on the outflow side housing end grid or mesh structure, the protrusion extends upstream of the outflow-side housing end face (6), and the second recess extends into the protrusion, and the protrusion (12) is reinforced by reinforcing ribs (13) formed on the protrusion (12) and on the grid or mesh structure and which intersect one another in an extension thereof in a region of a jet regulator longitudinal axis.

2. The jet regulator as claimed in claim 1, wherein the second slit-shaped recess (9) is provided in the first recess (8).

3. The jet regulator as claimed in claim 1, wherein the second slit-shaped recess (9) is provided in a slit base of the first recess (8).

4. The jet regulator as claimed in claim 1, wherein the first slit-shaped recess and the second slit-shaped recess (8, 9) have an identically shaped recess cross section with sides of the first slit-shaped recess including first slit-shaped recess longitudinal sides and recess narrow sides that are shorter than the first slit-shaped recess longitudinal sides.

5. The jet regulator as claimed in claim 1, wherein longitudinal axes of the first recess (8) and of the second recess (9) are arranged in one plane, and the second recess (9) is arranged centrally in a slit base of the first recess (8).

6. The jet regulator as claimed in claim 1, wherein the recess cross section of the second recess (9) tapers at least in one region in a direction of a slit base (11) thereof.

7. The jet regulator as claimed in claim 6, wherein the longitudinal sides of the second recess (9) extend toward one another in a direction of the slit base (11).

8. The jet regulator as claimed in claim 6, wherein the shorter sides of the second recess (9) extend toward one another in a direction of the slit base (11).

9. The jet regulator as claimed in claim 1, wherein the first recess (8) has a slit base formed as a circular arc that is adapted to receive a coin used as a turning tool.

10. The jet regulator as claimed in claim 1, wherein the second recess (9) is adapted to receive a screwdriver blade serving as a turning tool.

11. The jet regulator as claimed in claim 1, wherein the flow-through holes (7) are arranged at a distance from at least one of recess longitudinal or from recess narrow sides of the first recess (8) which is greater than a wall thickness of dividing or flow-guiding walls (14) of the grid or mesh structure, which are arranged between adjacent ones of the flow-through holes (7).

12. The jet regulator as claimed in claim 1, wherein the jet regulator (3) has a convexly arched or bulging housing end face.

13. The jet regulator as claimed in claim 1, wherein the outflow-side housing end face is connected integrally to the jet regulator housing (4).

14. The jet regulator as claimed in claim 1, wherein the jet regulator (3) is an aerated jet regulator or has a jet aerator.

15. The jet regulator as claimed in claim 1, wherein the jet regulator housing (4) has an inner housing circumferential wall (24) and at least one outer housing circumferential wall (25), which surrounds the inner housing circumferential wall (24) with a clearance, and at least one air admission passage (16) open to the outflow side of the jet regulator (3) and opening into an interior of the jet regulator housing (4) is provided in the interspace between the inner housing circumferential wall (24) and the adjacent outer housing circumferential wall (25).

16. The jet regulator as claimed in claim 1, wherein the jet regulator (3) has a jet splitter (17) having a plurality of splitter openings (18), said jet splitter (17) deflects through-flowing water outward or divides it into individual jets, or both.

17. The jet regulator as claimed in claim 16, wherein the jet splitter (17) is a pot-shaped diffuser having a pot base (19), which is oriented transversely to a flow-through direction of inflowing water and deflects the water sideways, and has the splitter openings (18) located on a circumferential wall (20) of the pot-shaped diffuser.

18. The jet regulator as claimed in claim 16, wherein the splitter openings (18) open into an annular passage (21), which tapers at least in one section in a flow-through direction, and at least one air admission passage (16) having a passage opening (22) leads into a housing interior arranged in an outflow-side region of an annular passage (21) or in a partial region of a housing inner circumference adjoining the annular passage (21) on an outflow side.

19. The jet regulator as claimed in claim 1, wherein the jet regulator is arranged downstream of a flow limiter or a flow control valve (23) in a flow direction and the jet regulator (3) and the upstream flow limiter or flow control valve (23) are releasably connected to one another.

20. The jet regulator as claimed in claim 1, a flow limiter or flow control valve (23) is interposed between an inflow-side front or filtering screen (2) and the outflow-side housing end face, and the front or filtering screen (2), the flow limiter or flow control valve (23) and the jet regulator (3) are releasably connected to one another to form a sanitary insert.

* * * * *